United States Patent [19]

Grounds

[11] Patent Number: 4,756,406

[45] Date of Patent: Jul. 12, 1988

[54] CONTAINER FOR MONEY, TOKENS OR SAVINGS STAMPS

[76] Inventor: Alan F. Grounds, 104 Felsham Road, Putney, London SW15 1DQ, England

[21] Appl. No.: 13,778

[22] Filed: Feb. 12, 1987

[51] Int. Cl.[4] ..... B65D 85/58; G07D 9/00

[52] U.S. Cl. ..... 206/0.8; 232/4 R; 232/7

[58] Field of Search ..... 206/0.8, 0.81, 37, 39; 446/8, 10; 232/4 R, 62; 194/349, 350, 351; 232/5–7, 44

[56] References Cited

U.S. PATENT DOCUMENTS

| | | | |
|---|---|---|---|
| 1,063,758 | 6/1913 | Yeo et al. | 232/62 |
| 1,268,723 | 6/1918 | Johnson | 232/7 |
| 1,353,970 | 9/1920 | Mullett | 232/7 |
| 1,443,943 | 2/1923 | Balson | 232/4 R |
| 1,455,498 | 5/1923 | Kusel | 232/4 R |
| 1,805,760 | 5/1931 | Coughlin | 232/4 R |
| 2,338,575 | 1/1944 | Daugherty | 232/7 |
| 2,950,945 | 8/1960 | Holm | 232/4 R |
| 3,547,344 | 12/1970 | Christensen | 232/43.2 |
| 3,992,805 | 11/1976 | Arkin | 46/2 |
| 4,315,592 | 2/1982 | Smith | 229/38 |

FOREIGN PATENT DOCUMENTS

| | | | |
|---|---|---|---|
| 473085 | 10/1937 | United Kingdom . | |
| 1421359 | 1/1976 | United Kingdom . | |
| 1600348 | 10/1981 | United Kingdom | 206/0.8 |

*Primary Examiner*—Jimmy G. Foster

*Attorney, Agent, or Firm*—Roylance, Abrams, Berdo & Goodman

[57] ABSTRACT

A container for money, tokens or savings stamps, which container comprises a body portion for retaining the money, tokens or savings stamps, and a feed member through which the money, tokens or savings stamps are fed to the body portion, the feed member having a funnel section which leads to a slot through which the money, tokens or savings stamps pass, and the feed member having a baffle positioned in spaced apart relationship to the slot and remote from the funnel section, the baffle being such that it allows money, tokens or savings stamps to pass through the slot and into the body portion whilst substantially preventing money, tokens or savings stamps from being taken from the body portion through the slot.

4 Claims, 2 Drawing Sheets

CONTAINER FOR MONEY, TOKENS OR SAVINGS STAMPS

This invention relates to a container for money, tokens or saving stamps.

Containers for money, tokens or saving stamps are well known. One particularly effective container is described in United Kingdom Patent No. 1600348. The container illustrated in the United Kingdom patent comprises a body portion for retaining money, tokens or saving stamps, and a feed member through which the money, tokens or saving stamps are fed to the body portion. The feed member has a funnel section which leads to a slot through which the money, tokens or saving stamps pass. The money, tokens or saving stamps are visible through the slot and, especially money in the form of paper money, tends to be subject to extraction attempts through the slot, despite considerable time and ingenuity being necessary. Such extraction attempts are undesirable, especially where the containers are used for the purpose of collecting money, tokens or saving stamps for fund raising, for example for charities.

It is an aim of the present invention to provide a container in which the above mentioned problem experienced with the container described in United Kingdom Pat. No. 1600348 is obviated or reduced.

Accordingly, this invention provides a hand held portable collecting container for money, tokens or saving stamps, which container comprises a body portion for retaining the money, tokens or saving stamps; and a feed member through which the money, tokens or saving stamps are fed to the body portion; the feed member being such that it is positioned in a top part only of the body portion in order to leave the body portion free for receiving the money, tokens or saving stamps; the feed member having a funnel section which leads to a slot through which the money, tokens, or saving stamps pass; the feed member having a single rigid baffle which is positioned beneath the slot but spaced apart from the slot by a pair of end wall members which define ends of the slot; the baffle being such that it allows the money, tokens or saving stamps to pass through the slot and into the body portion whilst substantially preventing the money, tokens or saving stamps from being taken from the body portion through the slot; the baffle having a pair of sloping sides which meet at an apex; the apex being centrally positioned beneath the slot and being such that it deflects the collected money, tokens or saving stamps down one or other of the pair of sloping sides; the base of the baffle being wider than the width of the slot; and the sides of the baffle being such that they do not continue the plane of the respective sides of the sloping walls but continue in a parallel lower plane so as to give a step which provides an additional barrier to the extraction of the contents of the container.

The money may be in the form of coins, bank notes or cheques. The tokens may be metal or plastics discs. The saving stamps may be like Green Shield saving stamps.

The funnel section may have a circular mouth, a pair of opposed sloping walls which slope towards and join the opposing longest sides of the slot, and a pair of opposed vertical walls which extend towards and join the opposing shorter sides of the slot.

Preferably, the pair of opposing sloping walls have outer surfaces which are not flat so that coins or tokens cannot lie flat against the outer surfaces of the opposed sloping walls. Thus the said outer surfaces may each be provided with a ridge member or they may be formed to be convex. If the coins or tokens cannot lie flat on the said outer surfaces they do not tend then to slide flat on to the sides of the baffle, from where extraction attempts with a knife or the like may be made with the container in an inverted or tilted position.

Advantageously, in order to ensure the smooth flow of money, tokens or saving stamps into the container, the pair of opposed sloping walls slope at an angle of from 40 to 65 degrees, and the pair of sloping sides of the baffle slope at an angle of from 35 to 90 degrees depending on the relation between the width of the slot and the minimum and maximum thicknesses of coins or tokens to be collected.

Usually, the funnel section and the baffle will be integrally moulded together.

The body portion may be rigid, collapsible or flexible.

The body portion may be a rigid sided box, a collapsible box or a bag. The container can be of any desired shape such for example as square, rectangular, triangular, circular or cylindrical.

The feed member may have a flange for enabling it to be secured to and removed from the body portion. Preferably, the feed member will be secured to the body portion by a snap action, although it is to be appreciated that other means of securing the feed member to the body portion may be employed.

The feed member may be made from any desired material. Preferably, a plastics material is employed since the feed member can then easily be moulded to shape. A presently preferred plastics material is polythene. The container can be made of various materials such for example as plastics materials, metal and cloth materials.

An embodiment of the invention will now be described solely by way of example and with reference to the accompanying drawings in which.

Figure 1:
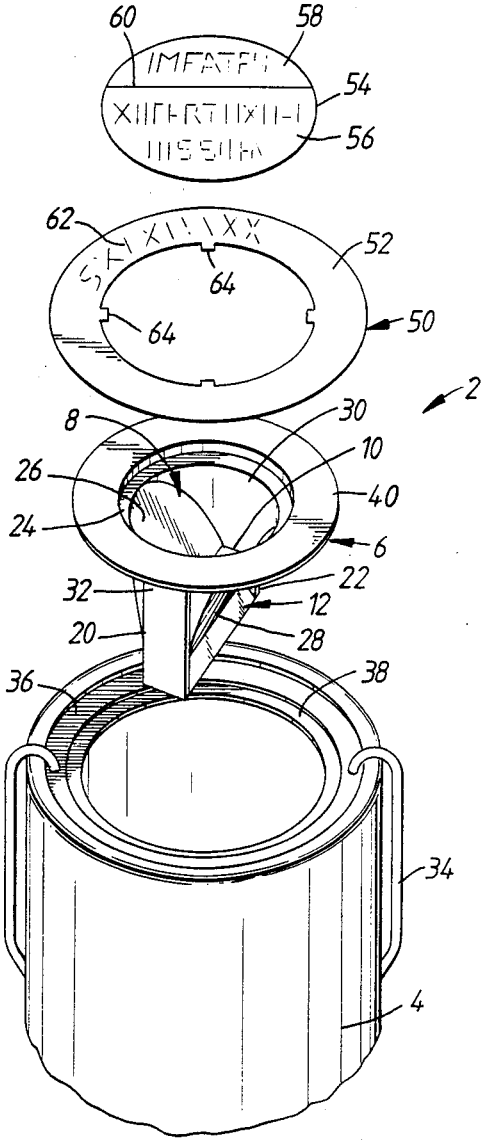
FIG. 1 is an exploded view of a container for money in accordance with the invention.

Referring to the drawings, there is shown a container 2 for collecting money. The container 2 comprises a body portion 4 for retaining the collected money. The container 2 also comprises a feed member 6 through which the collected money is fed to the body portion 4. The feed member 6 has a funnel section 8 which leads to a slot 10 through which the money passes.

The feed member 6 has a baffle 12 positioned in spaced apart relationship to the slot 10 and remote from the funnel section 8. The baffle 12 is of inverted V-shape as shown most clearly in FIG. 3 so that it has a pair of sloping sides 14,16 which meet at an apex 18. The apex 18 is centrally positioned beneath the slot 10 and is such that it deflects the money down one or other of the pair of sloping sides 14,16. The baffle 12 is secured in its position in spaced apart relationship to the slot 10 by pair of end wall members 20,22 which define the ends of the slot 10.

As shown most clearly in FIG. 1, the funnel section 8 has a circular mouth 24, a pair of opposed sloping walls 26, 28 which slope towards and join the opposing longest sides of the slot 10 as shown, and a pair of opposed vertical walls 30,32 which extend towards and join the opposing shortest sides of the slot 10 and which then further extend to form the end wall members 20,22. As will be seen from FIG. 1, the funnel section 8 and the baffle 12 are integrally moulded together.

The body portion is illustrated as a cylindrical rigid wall body portion 4 which is provided with a string handle 34. The body portion 4 has a pair of shoulders 36,38 as shown most clearly in FIG. 3. Also as shown most clearly in FIG. 3, the feed member 6 has a pair of circular lips 40,42 which define between them a groove 44 for receiving a flange 46, which forms the lower part of the shoulder 38. The lower part of the lip 42 is inclined as shown at position 48 and so can be a push fit over the flange 46. The feed member 6 thus clips to the body portion 4 but can be levered out, for example with a knife, when it is desired to obtain the money from the body portion 4.

As indicated in the United Kingdom Pat. No. 1600348, the container 2 may be used with a seal 50 which may be made of paper or other material and which may carry a message or other data. The seal 50 may be circular and it may comprise an outer annular portion 52 and an inner circular portion 54. The inner circular portion 54 may be sub-divided into a larger and smaller part 56,58 respectively, the division between the parts 54 and 56 being effected by a line 60. The seal 50 may be self adhesive so that a backing sheet may be removed from all or part of the seal 50 to expose the adhesive provided thereon. The exposed portions may then be separated and the annular portion 52 can be stuck on to the container with the inner perimeter of the annular portion 52 extending over the outer portion of the uppermost part of the feed member 6. This annular portion may carry lettering 62, for example for indicating the cause for which money is being collected. The separated inner circular portion 54 of the seal 50 may then be used such that one of the two portions 56,58 is printed and used for example as a badge for the authorised user of the container 2, whilst the other portion is printed and used for example as an identification label which can then be stuck on the body portion where appropriate.

If desired, the various portions of the seal 50 may be joined together by small bridging sections 64 so that the various parts of the seal 50 remain secured together even after the protective backing sheet has been removed, or where the seal 50 is not provided with a backing sheet and separate adhesive is required.

Figure 2:
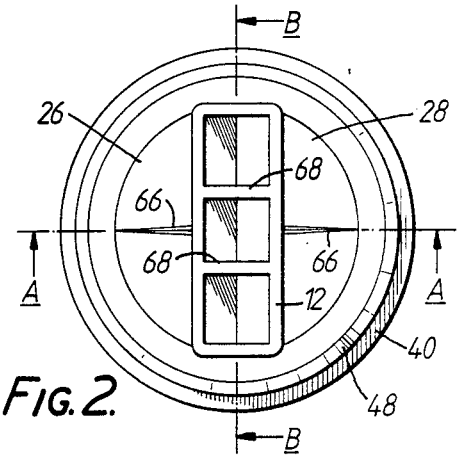
FIG. 2 is an underneath plan view of the feed member shown in FIG. 1.
Figure 3:
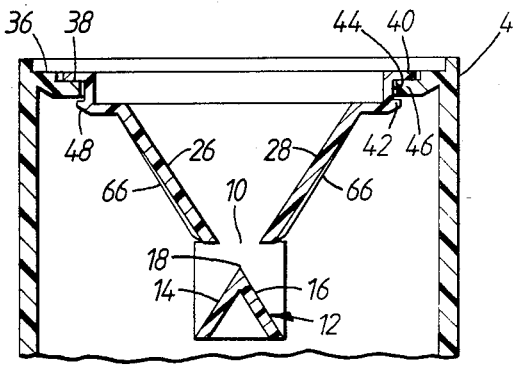
FIG. 3 is a section on the line AA shown in FIG. 2 and shows also part of the body portion of the container.
Figure 4:
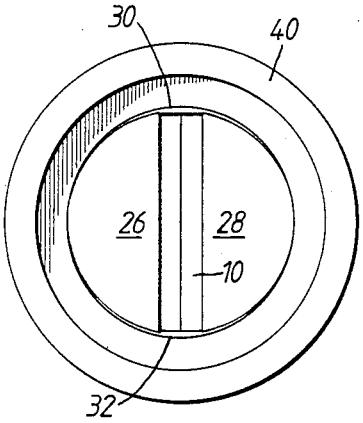
FIG. 4 is a top plan view of the feed member shown in FIG. 2.
Figure 5:
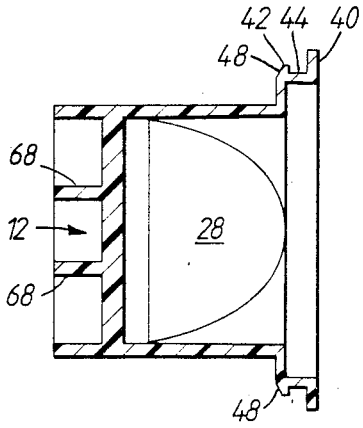
FIG. 5 is a section on the line BB shown in FIG. 2.

As shown in FIGS. 1, 2 and 3, the outer faces of the sloping walls 28 are each provided with a rib member 66 for preventing coins or tokens lying flat against the said outer faces. If coins or tokens lie flat on the said outer faces, then they may slide in a flat manner against the sloping sides 14,16 of the baffle 12 from where they may be subject to extraction attempts by persons passing a knife or similar instrument through the slot 10 with the container 2 in an inverted or tilted position.

It is to be appreciated that the embodiment of the invention described above has been given by way of example only and that modifications may be effected. Thus, for example, the slot 10 might be slightly widened at its centre to form a circular aperture for easing the insertion of a rolled up bank note or rolled up saving stamps into the body portion 4. In this case, the complementary portion of the baffle 12 may be similarly shaped. Although the baffle 12 has been shown as being of inverted V-shape with two cross bracing portions 56,68, it will be appreciated that more cross bracing portions may be employed or the entire baffle 12 may be solid. The base of the baffle 12 is wider than the width of the slot 10 as shown in FIG. 3. Although the container 2 shown in the drawings is for collecting money from the general public for specific causes, it is to be understood that the invention also extends to simple money containers such as money boxes as used by children in their homes. Also, the container 2 may be used for coins or saving stamps. The rib members 66 may be omitted if desired by moulding the feed member 6 such that the outer faces of the sloping walls 28 are convex.

I claim:

1. A hand held portable collecting container for money, tokens or saving stamps, which container comprises a body portion for retaining the money, tokens or saving stamps; and a feed member through which the money, tokens or saving stamps are fed to the body portion; the feed member being such that it is positioned in a top part only of the body portion in order to leave the body portion free for receiving the money, tokens or saving stamps; the feed member having a funnel section which leads to a slot through which the money, tokens or saving stamps pass; the feed member having a single rigid baffle which is positioned beneath the slot but spaced apart from the slot by a pair of end wall members which define ends of the slot; the baffle being such that it allows the money, tokens or saving stamps to pass through the slot and into the body portion whilst substantially preventing the money, tokens or saving stamps from being taken from the body portion through the slot; the baffle having a pair of sloping sides which meet at an apex; the apex being centrally positioned beneath the slot and being such that it deflects the collected money, tokens or saving stamps down one or other of the pair of sloping sides; a base of the baffle being wider than the width of the slot; and the sides of the baffle being such that they do not continue the plane of respective sides of the funnel section but continue in a parallel lower plane so as to give a step which provides an additional barrier to the extraction of the contents of the container.

2. A container according to claim 1 in which the funnel section has a circular mouth, a pair of opposed sloping walls which slope towards and join opposing longest sides of the slot, and a pair of opposed vertical walls which extend towards and join opposing shorter sides of the slot, the pair of opposed sloping walls being such that they have outer surfaces which are not flat so that coins or tokens cannot lie flat against the outer surfaces of the opposed sloping walls.

3. A container according to claim 2 in which the funnel section and the baffle are integrally moulded together, and in which the pair of opposed sloping walls of the funnel section slope at an angle of from 40–65 degrees.

4. A container according to claim 3 in which the feed member has a flange for enabling it to be secured to and removed from the body portion by a snap action.

* * * * *